United States Patent [19]

Davis et al.

[11] Patent Number: 4,886,019

[45] Date of Patent: Dec. 12, 1989

[54] ENGINE BREATHER ASSEMBLY WITH OIL DRAIN BACK

[75] Inventors: Thomas L. Davis, Tulsa; Roy A. Harper, Jr., Broken Arrow, both of Okla.

[73] Assignee: Arrow Specialty Company, Tulsa, Okla.

[21] Appl. No.: 270,169

[22] Filed: Nov. 14, 1988

[51] Int. Cl.[4] ..... F01M 13/00

[52] U.S. Cl. ..... 123/41.86; 123/574; 55/420; 55/DIG. 19

[58] Field of Search ..... 123/41.86, 196 CP, 574, 123/573; 55/DIG. 19, 420

[56] References Cited

U.S. PATENT DOCUMENTS

| | | | |
|---|---|---|---|
| 3,087,474 | 4/1968 | Catha | 123/41.86 |
| 3,550,567 | 12/1970 | Crow | 123/41.86 |
| 3,721,069 | 3/1973 | Walker | 55/319 |
| 3,875,916 | 4/1975 | Patton | 123/41.86 |
| 2,493,617 | 1/1950 | Chubbuck | 123/41.86 |
| 4,579,092 | 4/1986 | Kandler | 123/41.86 |

FOREIGN PATENT DOCUMENTS

| | | | |
|---|---|---|---|
| 613386 | 6/1947 | United Kingdom | 55/420 |
| 1255642 | 12/1971 | United Kingdom . | |

*Primary Examiner*—Noah P. Kamen

*Attorney, Agent, or Firm*—Edgar A. Zarins; Malcolm L. Sutherland

[57] ABSTRACT

A breather assembly for a combustion engine which conserves oil by condensing oil vapors from the engine and returning the oil to the crankcase. The breather assembly is mounted to the crankcase cover and includes a drain tube extending into a low pressure area of the crankcase. The breather includes a baffled interior chamber with an inlet opening at its lower end having a valving mechanism biased towards the closed position. Vapor travels through the valve into the chamber and over a baffle wall into an outer annulus. Breather holes at the bottom of the annulus allow gases to escape. Oil is condensed as the vapor travels up the inner chamber. A vacuum created by the crankcase through the drain back tube causes the condensed oil to flow back into the crankcase. In a preferred embodiment, the breather assembly is molded using a polyurethane material.

17 Claims, 2 Drawing Sheets

ENGINE BREATHER ASSEMBLY WITH OIL DRAIN BACK

BACKGROUND OF THE INVENTION

I. Field of the Invention

This invention relates to a breather assembly for an internal combustion engine and, in particular, to a breather assembly which mounts to the crankcase valve cover of the engine and includes a drain back tube for returning condensed oil to the crankcase for more efficient operation of the engine.

II. Description of the Prior Art

Internal combustion engines require proper crankcase ventilation for efficient operation. Crankcase vapors are in constant circulation and highly turbulent during engine operation. The crankcase vapor includes oil which must be separated from the vapor before vapor is released to the atmosphere. In order to control the ventilation of the crankcase a breather device is utilized to allow air to pass into and out of the crankcase as pressure within the crankcase changes during operation of the engine. However, merely expelling the crankcase vapors results in uneconomical operation since the oil within the vapor is lost. Furthermore, the oil vapor will deposit on the external parts of the engine and pollute the atmosphere.

Breather assemblies for past internal combustion engines have included intricate baffling and filtering mediums to condense and filter the oil from the vapors travelling through the breather. The prior known breathers included multiple baffle chambers through which the vapor must travel and which cause the oil to condense within the breather. The liquid oil would thereafter drip out of the bottom of the breather back into the crankcase. Other breathers use the filtering material to condense the oil vapor which accumulates in the bottom of the breather housing and drips back into the crankcase. The past known assemblies depend upon a specific accumulation of oil before it is returned to the crankcase.

SUMMARY OF THE PRESENT INVENTION

The present invention overcomes the disadvantages of the prior known breathers by providing a simple assembly which is mounted to the valve cover of an internal combustion engine and which includes a drain back tube leading to a low pressure area of the crankcase which creates a vacuum within the tube to draw the accumulated oil back into the crankcase. As a result, accumulated oil does not continue to mix with the incoming vapors.

The breather assembly according to the present invention includes a housing which forms the baffled flow passageway of the breather. The housing includes a stem having an axial passageway and a cap mounted to the stem to form the circuitous flow path. The stem includes an annular flange which includes threads to engage the cap and circumferentially spaced exhaust ports through which the engine vapors pass. The axial passageway through the stem includes a restricted portion which facilitates condensation of the oil as the vapors pass therethrough. The lower end of the stem includes external threads for mounting the breather to the valve cover. A check valve and drain back tube are mounted within the passageway to allow the vapor to flow into the breather assembly and returning condensed oil to the crankcase, respectively.

Other objects, features, and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the view and in which.

DETAILED DESCRIPTION OF A PREFERRED EMBODIMENT OF THE PRESENT INVENTION

Figure 1:
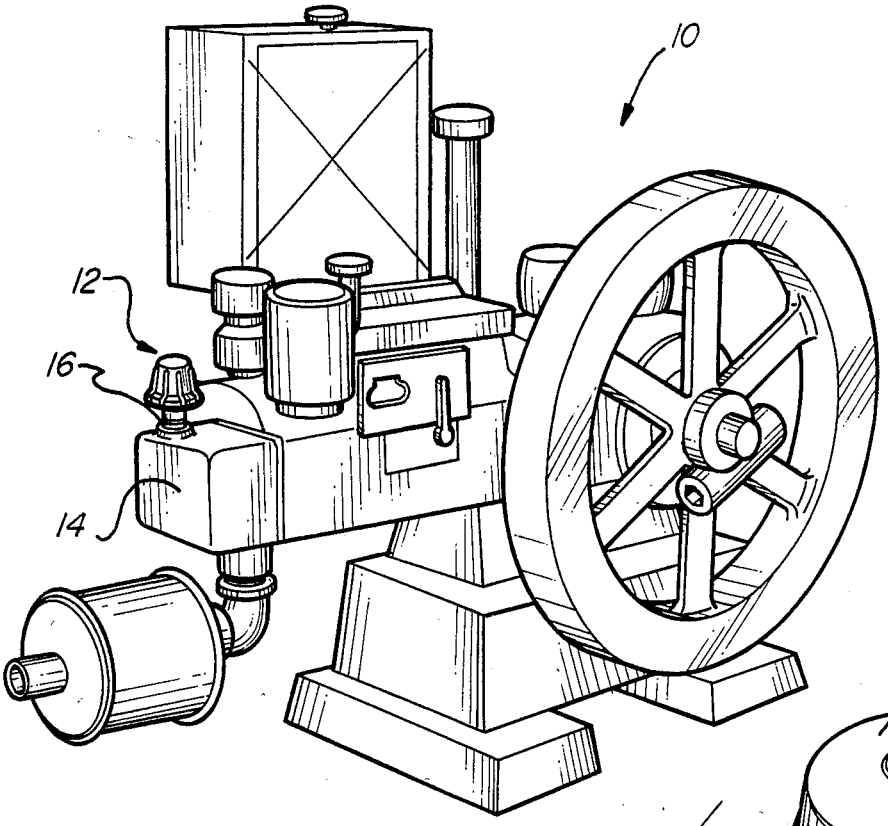
FIG. 1 is an elevated perspective of an internal combustion engine having the breather assembly embodying the present invention mounted to the valve cover of the engine.
Figure 2:
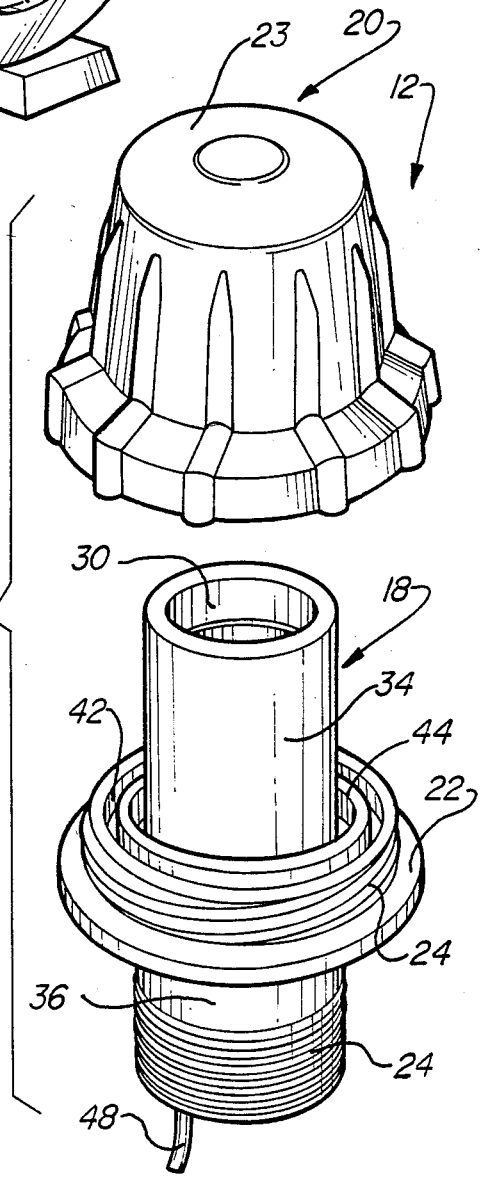
FIG. 2 is an exploded view of the breather assembly embodying the present invention.

Referring first to FIG. 1, there is shown an internal combustion engine 10 of the type used in oilfield applications. The engine 10 has mounted thereto a breather assembly 12 embodying the present invention. In a preferred embodiment, the breather assembly 12 is mounted to the valve or crankcase cover 14 of the engine 10 to vent gases from the engine 10 providing efficient ventilation. The breather assembly 12 is preferably threadably mounted within an opening 16 in the valve cover 14. The breather assembly 12 is adapted to ventilate gases from the crankcase while causing oil vapors to condense to liquid form prior to expulsion of the gases through the assembly 12 resulting in cleaner and more efficient operation of the engine 10.

Referring now to FIGS. 2 through 6, the breather assembly 12 generally comprises a substantially tubular stem 18 and a cap 20 mounted to the stem 18. The stem 18 includes an integral outer annular flange 22 formed at approximately the mid-point to the stem 18. The cap 20 has a substantially domed configuration with a concave upper wall 23. In a preferred embodiment, the stem 18 and cap 20 are molded from a polyurethane material. The flange 22 is provided with threads 24 which engage matching threads 26 on the cap 20 to secure the cap 20 to the annular flange 22 of the stem 18. The lower end of the stem 18 is also provided with threads 28 for mounting the breather assembly 12 within the opening 16 of the valve cover 14.

The stem 18 has an axial fluid passageway 30 which communicates with the interior of the engine 10. The axial passageway 30 includes a restricted intermediate port 32 which has a smaller diameter than the diameter of the axial passageway 30. The restricted portion 32 is preferably positioned approximately midway through the passageway 30 and facilitates condensation of the oil vapors as they pass through the passageway 30 as will be subsequently described. Thus, the outer flange 22 and the restricted port 32 divide the stem 18 into an upper tubular portion 34 and a lower tubular portion 36. The upper tubular portion 34 of the stem 18 acts as an upwardly extending baffle wall over which the expulsion gases must pass prior to venting to the atmosphere. When the cap 20 is mounted to the stem 18, the baffle wall 34 extends almost to the domed upper wall 23 of the cap 20. The domed configuration of the cap 30 will direct expulsion gases radially outwardly and downwardly into the annulus 38 formed between the cap 20 and the upper tubular portion 34 of the stem 18. The domed wall 23 also facilitates further condensation of the oil vapors.

The outer annular flange 22 includes a plurality of vent openings 40 circumferentially spaced around the flange 22. The vent openings 40 allow fluid communication between the annulus 38 and the exterior environment to expel the engine vapors from the engine 10 and the breather assembly 22. The vent openings 40 are circumferentially spaced along an outer annular groove 42 in the flange 22 which helps to direct the gases through the openings 40. An inner annular collection groove 44 will collect any oil which may condense out of the vapor after passing over the baffle wall 34 into annulus 38.

Figure 3:
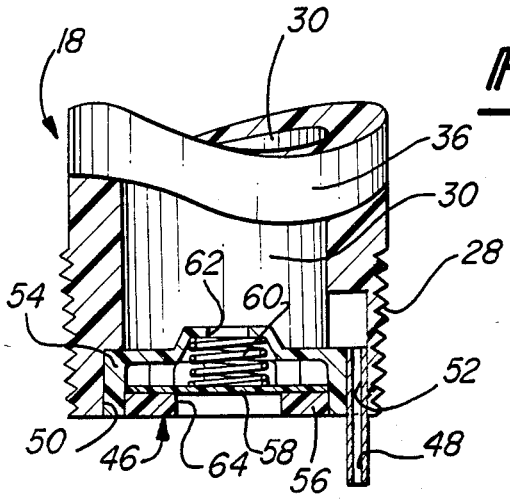
FIG. 3 is a partial cross-sectional perspective of the breather assembly with a check valve and drain back tube mounted therein.
Figure 4:
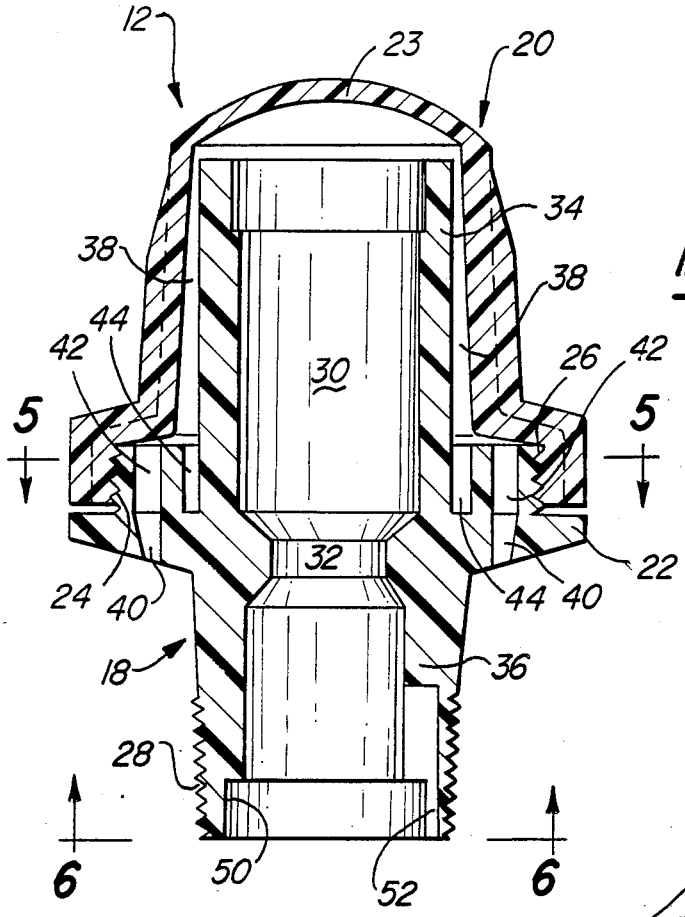
FIG. 4 is a cross-sectional perspective of the breather assembly embodying the present invention without the check valve and drain back tube.
Figure 5:
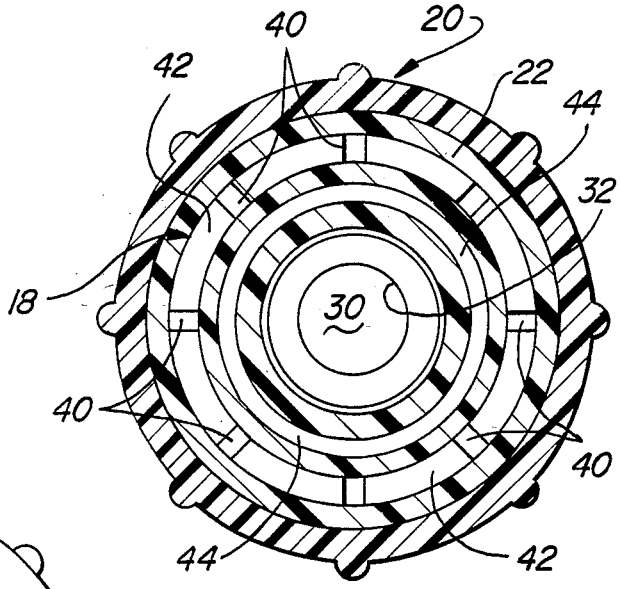
FIG. 5 is a cross-sectional perspective of the breather assembly taken along line 5—5 of FIG. 4.
Figure 6:
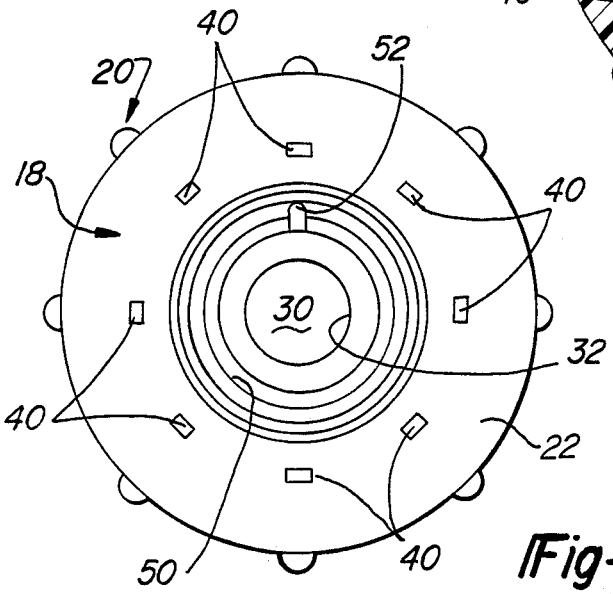
FIG. 6 is an end view of the breather assembly taken along line 6—6 of FIG. 4.

Referring now to FIG. 3, in order to prevent air or gases from passing through the breather assembly 12 into the engine 10 and to return condensed oil back to the engine 10, a check valve 46 and drain back tube 48 are mounted within the lower tubular portion 36 of the stem 18. The lower end of the stem 18 is provided with an annular shoulder 50 to receive the check valve 46 and a notch 52 to receive the drain back tube 48 in proximate location to the check valve 46. The drain back tube 48 is a simple, preferably flexible, tube which provides fluid communication between the axial fluid passageway 30 and a low pressure area of the crankcase 14 such that condensed oil which collects in the bottom of the passageway 30 will be virtually sucked back into the crankcase through the tube 48. The check valve 46 includes a valve housing 54 and a valve seat 56 between which a valving plate 58 is biased by a spring 60. The spring 60 is disposed between the valve housing 54 and the valving plate 58 so as to bias the plate 58 against the valve seat 56 to close the check valve 46. The valve housing 54 includes at least one port 62 through which the engine vapors may pass into the axial fluid passageway 30. Engine vapors expelled through the opening 16 in the valve cover 14 will flow through the aperture 64 of the valve seat and move the valving plate 58 against the force of the spring 60 to open the check valve 46 and allow flow into the axial passageway 30. When a vacuum is created or the engine is not running, the check valve 46 will close under the force of the spring 60.

The breather assembly 12 of the present invention allows the expulsion of engine vapors from the internal combustion engine 10 while maintaining clean and economical operation of the engine 10 by condensing oil from the vapors and returning it to the engine crankcase 14. The oil-laden engine vapors pass through the check valve 46 into the axial fluid passageway 30 of the breather assembly 12. As the vapors flow upwardly through the passageway 30 and the restrictive port 32 oil will condense out of the vapors against the inner walls and will flow to the bottom of the stem 18. Virtually all of the oil will be condensed out of the vapors by the time the vapors pass over the rim of the baffle wall 34. The engine vapors will thereafter be expelled through the vent openings 40 into the surrounding atmosphere. Collected oil will flow through the drain back tube 48 into the engine 10. Thus, oil which may foul the external components of the engine 10 or pollute the atmosphere will be condensed from the expelled engine vapors for re-use by the engine 10.

The foregoing detailed description has been given for clearness of understanding only and no unnecessary limitations should be understood therefrom as some modifications will be obvious to those skilled in the art without departing from the scope and spirit of the appended claims.

I claim:

1. A breather assembly for an internal combustion engine to expel vapors from the engine, said breather assembly mounted to the engine, said breather assembly comprising:

a stem having an axial fluid passageway communicating with the engine and an annular outer flange;

a cap to said stem to form a baffled interior chamber communicating with said axial passage said cap connected to send annular flange;

vent means communicating with said interior chamber for expelling vapors from said chamber through said annular flange;

valve means disposed in said axial passageway of said stem, said valve means opening in response to the flow of vapors into said axial passageway; and a drain back tube for returning condensed oil to the engine, said tube mounted in said stem to provide fluid communication between said axial passageway and the engine.

2. The breather assembly as defined in claim 1 wherein said vent means comprises a plurality of vent openings formed in said annular flange to provide fluid communication between said interior chamber and the exterior of said breather assembly.

3. Breather assembly as defined in claim 2 wherein said annular flange is formed intermediate on said stem, said stem including an upper tubular portion above said flange and a lower tubular portion below said flange, said upper tubular portion extending into said cap to form an upwardly extending baffle wall of said chamber.

4. The breather assembly as defined in claim 3 wherein said lower tubular portion includes threads to threadably mount said breather assembly to an opening in the engine.

5. The breather assembly as defined in claim 3 wherein said axial fluid passageway of said stem includes a restricted flow port to facilitate condensation of oil within the breather assembly.

6. The breather assembly as defined in claim 5 wherein said valve means includes a spring-biased check valve mounted in the lower end of said lower tubular portion to restrict the flow of air from said breather assembly into the engine while allowing the expulsion of engine vapors from the engine into said breather assembly, vapors from the engine traversing a circuitous flow path through said restricted flow port and axial passageway over a rim of said upwardly extending baffle wall and through said vent openings in said annular flange.

7. The breather assembly as defined in claim 6 wherein said drain back tube is mounted in said lower tubular portion of said stem proximate said check valve to provide fluid communication between said axial passageway and said engine.

8. The breather assembly as defined in claim 7 wherein said breather assembly is mounted to a crankcase cover of the engine, said drain back tube returning condensed oil to the crankcase of the engine.

9. The breather assembly as defined in claim 3 wherein said cap has a height substantially equal to said upper tubular portion of said stem such that said upper tubular portion extends almost to an upper wall of said cap.

10. The breather assembly as defined in claim 9 wherein said cap has a domed top.

11. The breather assembly as defined in claim 10 wherein said cap and said stem are molded from a polyurethane material.

12. A breather assembly for an internal combustion engine, the engine having an opening in the crankcase cover to receive said breather assembly, engine vapors being expelled through said breather assembly, said breather assembly comprising:

a tubular stem having an axial fluid passageway communicating with the engine and an integral outer annular flange formed intermediate said stem, said stem including an upper tubular portion above said flange and a lower tubular portion below said flange;

a cap mounted to said annular flange of said stem to form an interior chamber communicating with said axial passageway, said upper tubular portion extending into said cap to form an upwardly extending baffle wall of said chamber;

a plurality of vent openings formed in said annular flange, said vent openings communicating with said interior chamber for expelling vapors from said chamber;

a spring-biased check valve disposed in said lower tubular portion, said check valve restricting the flow of air from said breather assembly into the engine crankcase while allowing the expulsion of engine vapors from the engine crankcase into said breather assembly; and a drain back tube for returning oil condensed from the engine vapors to the engine, said tube mounted in said stem to provide fluid communication between said axial passageway and the engine crankcase.

13. The breather assembly as defined in claim 12 wherein said axial fluid passageway of said stem includes a coaxial restricted flow port to facilitate condensation of oil from the engine vapors within said breather assembly.

14. The breather assembly as defined in claim 12 wherein said stem includes threads for threadably mounting said breather assembly into the opening of the engine crankcase cover, said drain back tube extending through the lower end of said stem into the engine crankcase.

15. The breather assembly as defined in claim 14 wherein said cap includes a dome upper wall, said upper tubular portion of said stem extending into said cap in close proximity to said upper wall, vapors from the engine traversing a circuitous flow path through said axial passageway and restricted flow port over a rim of said upwardly extending baffle wall into said chamber and through said vent openings in said annular flange.

16. The breather assembly as defined in claim 15 wherein said cap and said stem are molded from a polyurethane material.

17. A breather assembly for an internal combustion engine, the engine having an opening in the crankcase cover to receive said breather assembly, engine vapors being expelled from the crankcase through said breather assembly, said breather assembly comprising:

a tubular stem having an axial fluid passageway communicating with the engine and an integral outer annular flange formed intermediate said stem, said stem including an upper tubular portion above said flange and a lower tubular portion below said flange, said axial passageway including a coaxial restricted flow port;

a cap threadably mounted to said annular flange of said stem to form an interior baffle chamber communicating with said axial passageway, said upper tubular portion extending into said cap to form an upwardly extending baffle wall of said chamber, vapors from the engine traversing a circuitous flow path through said restricted flow port and axial passageway over a rim of said upwardly extending baffle wall and downwardly through an annulus formed by said upper tubular portion and said cap;

a plurality of vent openings formed in circumferential spaced apart relation in said annular flange at the lower end of said annulus, said vent openings communicating with said interior chamber for expelling vapors from said chamber;

a spring-biased check valve mounted in said lower tubular portion at the lower end of said axial passageway, said check valve restricting the flow of air from said breather assembly into the engine crankcase while allowing the expulsion of engine vapors from the engine crankcase into said breather assembly; and a drain back tube for returning oil condensed from the engine vapors to the engine crankcase, said tube mounted in the lower end of said axial passageway proximate said check valve to provide fluid communication between said axial passageway and the engine crankcase.

* * * * *